US006126235A

United States Patent [19]

Grove

[11] Patent Number: 6,126,235

[45] Date of Patent: Oct. 3, 2000

[54] CHAIR BACK WITH ADJUSTABLE LUMBAR CUSHION AND CLOTHES HANGER HOOK INCLUDED WITHIN A HANDLE

[76] Inventor: James E. Grove, 4316 Marina City Dr., #433CTN, Marina del Rey, Calif. 90292

[21] Appl. No.: 09/425,915

[22] Filed: Oct. 25, 1999

[51] Int. Cl.[7] ..... A47C 3/025; A47C 7/62

[52] U.S. Cl. ..... 297/284.7; 297/284.5; 297/188.04; 297/188.03

[58] Field of Search ..... 297/284.1, 284.4, 297/284.5, 284.7, 188.04, 188.03, 183.1, 183.7, 183.6

[56] References Cited

U.S. PATENT DOCUMENTS

| | | | |
|---|---|---|---|
| 567,096 | 9/1896 | Harvey et al. . | |
| 1,007,985 | 11/1911 | Smith . | |
| 1,304,368 | 5/1919 | Purcell . | |
| 1,734,179 | 11/1929 | Olson . | |
| 2,033,520 | 3/1936 | Gubitz . | |
| 2,060,298 | 11/1936 | Gailey | 155/182 |
| 2,294,039 | 8/1942 | Looney . | |
| 2,564,924 | 8/1951 | Patton . | |
| 3,059,971 | 10/1962 | Becker | 297/353 |
| 3,279,849 | 10/1966 | Radke et al. . | |
| 3,642,322 | 2/1972 | Bilancia . | |
| 4,161,337 | 7/1979 | Ross et al. | 297/230 |
| 4,362,334 | 12/1982 | Ross et al. . | |
| 4,632,454 | 12/1986 | Naert . | |
| 4,711,488 | 12/1987 | Ohanessian . | |
| 4,711,492 | 12/1987 | Asbjornsen et al. . | |
| 4,862,536 | 9/1989 | Pruit | 5/432 |
| 5,553,917 | 9/1996 | Adat | 297/230.14 |
| 5,860,699 | 1/1999 | Week | 297/284.6 |
| 5,961,181 | 10/1999 | Salehi et al. . | |

*Primary Examiner*—Milton Nelson, Jr.
*Attorney, Agent, or Firm*—Jack C. Munro

[57] ABSTRACT

A chair back which includes a recessed handle formed within the rear surface of the chair back. Included within the recess is a hook that is adapted to engage with a clothes hanger on which is to be located an article of clothing. Within the front surface of the chair back is located a vertically oriented slit. A lumbar support pad, which has a pair of protuberances extending from its rear surface, is to be mountable in conjunction with the chair back with the protuberances engaging with the slit in a frictionally snug manner. The lumbar support pad is to be adjustable along the length of the slit.

3 Claims, 2 Drawing Sheets

CHAIR BACK WITH ADJUSTABLE LUMBAR CUSHION AND CLOTHES HANGER HOOK INCLUDED WITHIN A HANDLE

BACKGROUND OF THE INVENTION

1) Field of the Invention

The field of this invention relates generally to chairs and more particularly to a novel chair back that includes both a handle and a lumbar support.

2) Description of the Prior Art

The structure of the present invention is designed in particularly to be used in conjunction with a chair back for a chair that is designed for a business, such as an office. However, it is considered to be within the scope of this invention that the subject matter of this invention could be utilized in chairs that are also designed for the home.

A chair that is designed for a business is generally referred to as an executive type of chair. Executive type of chairs, when not occupied, are designed to be located within the well or kneehole area of the desk. In order for the user to then use the chair, it requires that the user pull the chair from the well. Chairs that are in exceedingly common use do not include a handle to facilitate this movement of the chair.

Additionally, people that work in offices commonly wear suits and suits include a suit jacket. It is common that when an individual is working at his or her desk, the individual does not wear the jacket. This means that the jacket is removed and hung somewhere. It would be desirable to incorporate some kind of a hanging mechanism for the jacket in conjunction with the chair that will locate the suit jacket in a location facilitating its wearing when possibly the wearer is expecting guests or about ready to conduct a meeting.

Additionally, for comfort it has been known to construct a lumbar support pad in conjunction with a chair. Because such a lumbar support pad is directly related to the size of the individual, it is common that the lumbar support pad be adjustable relative to the chair to different positions so as to accommodate to different sizes of individuals. In the past, the adjustment mechanism for lumbar support pads has been exceedingly complex. There is a need to construct a lumbar support pad in conjunction with a chair that is simple in construction thereby minimizing its cost at manufacture and also making the adjustment procedure simplified.

SUMMARY OF THE INVENTION

A chair back which has a front surface and a rear surface with the front surface to be located directly adjacent the back of the user when the chair back is utilized. Within the rear surface of the chair back there is included a handle which includes a recess formed within the rear surface. Within the recess is mounted a hook with this hook being adapted to engage with a garment hanger upon which is to be suspended a garment, such as a suit jacket. Within the front surface of the chair back there is included a vertically oriented slit and a lumbar pad which has a smoothly contoured outer surface and an inner surface which has mounted thereon at least one protuberance. This protuberance is to engage with the slit in a frictionally engaging snug manner with the lumbar pad to be adjustable relative to the chair back by moving of the lumbar support pad to different vertical positions relative to the chair back. Once a desired adjustment of the lumbar support pad has been obtained, the lumbar support pad will remain in its established position due to the frictional engagement of the slit with the protuberance.

DETAILED DESCRIPTION OF THE PREFERRED EMBODIMENT

Figure 1:
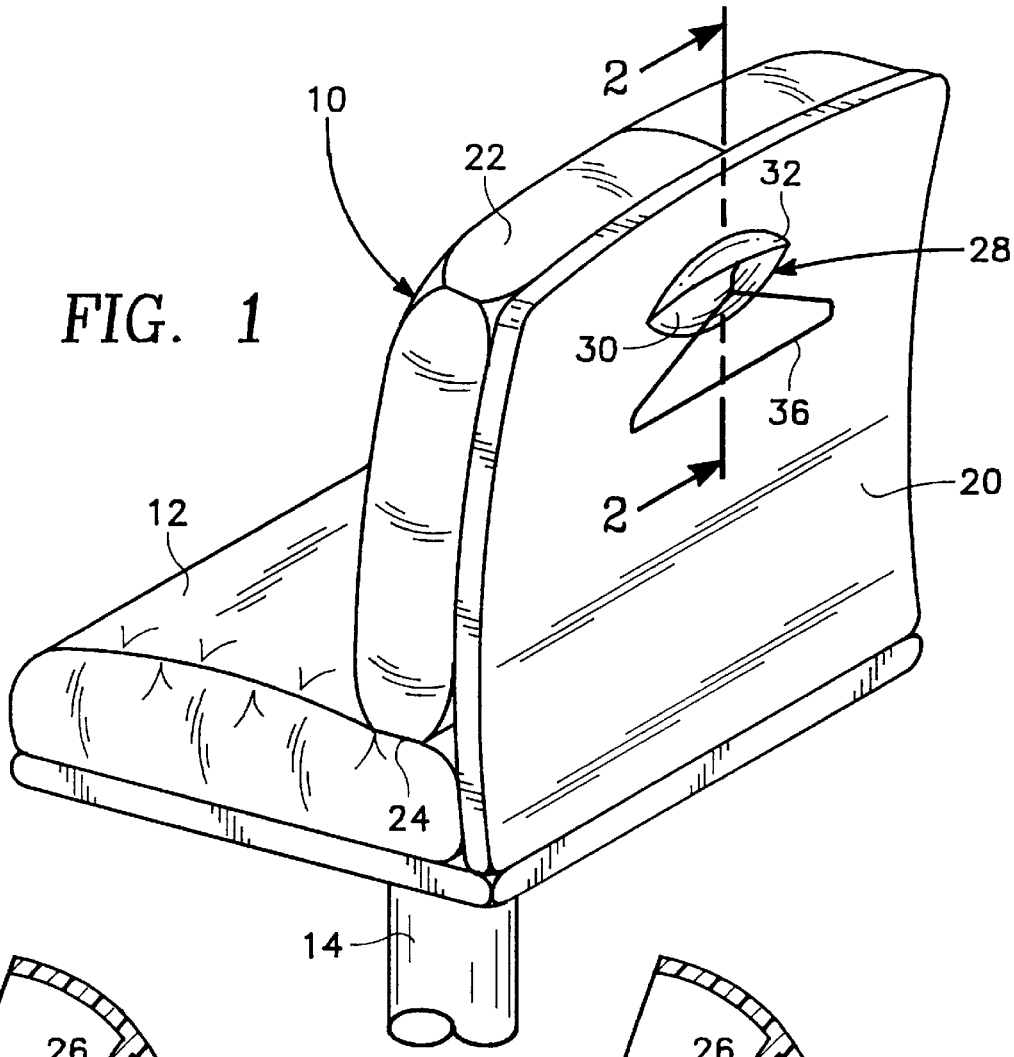
FIG. 1 is a rear isometric view of the chair back of the present invention.
Figure 2:
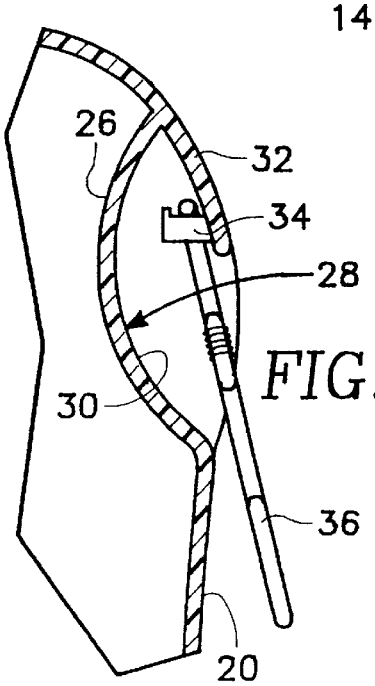
FIG. 2 is a cross-sectional view through the handle incorporated within the rear surface of the chair back of the present invention taken along line 2—2 of FIG. 1 showing the hook that is included within the handle being connected with a clothes hanger.
Figure 3:
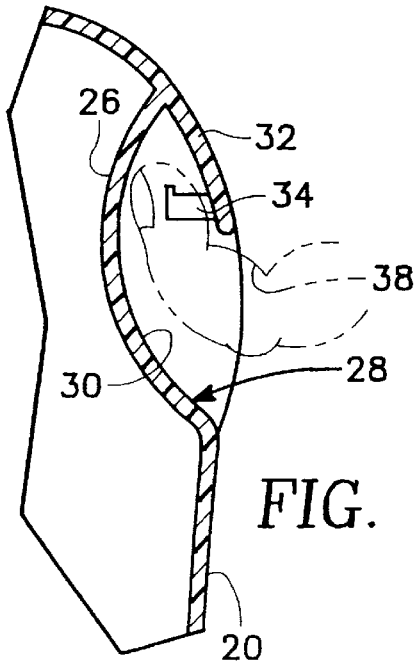
FIG. 3 is a cross-sectional view similar to FIG. 2 but showing usage of a user's hand in connection with the handle in order to facilitate movement of the chair.
Figure 5:
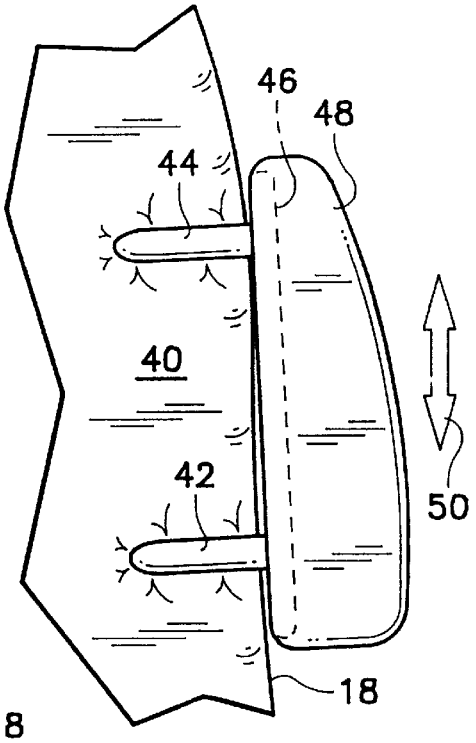
FIG. 5 is a cross-sectional view taken along line 5—5 of FIG. 4.
Figure 4:
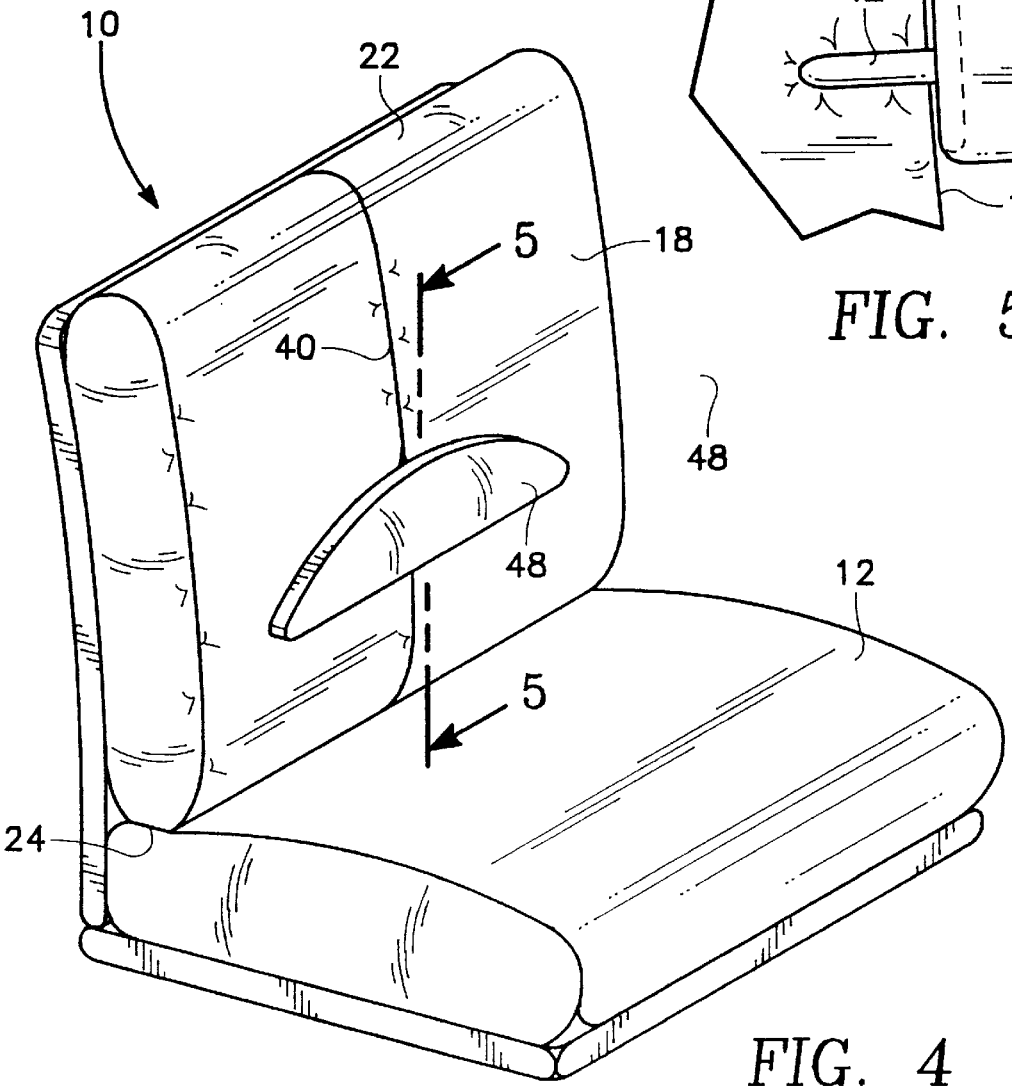
FIG. 4 is an isometric view of the front surface of the chair back of the present invention showing the mounting arrangement of the lumbar support pad.

Referring particularly to the drawings, there is shown in FIGS. 1 and 4 a chair back 10 that is to be mounted to a chair seat 12. The chair seat 12 is to be mounted on a pedestal 14. There is attached to the pedestal 14 a series of legs, which are not shown. The legs 16 locate the chair on a supporting surface.

The chair back 10 has a front surface 18 and a rear surface 20. When an individual is sitting within the chair seat 12, the individual's back is to be located directly adjacent the front surface 18. The chair back 10 also includes a top edge 22 20 and a bottom edge 24. The bottom edge 24 is located directly adjacent the chair seat 12. Normally, the chair back 10 will be constructed of a frame and a cushion type of material and will be covered with a fabric, leather or plastic material.

Formed within the rear surface 20 is an indentation 26. Mounted within the indentation 26 is a handle 28. The handle 28 includes a recess 30. Covering a portion of the recess 30 is a lip 32. Fixedly mounted interiorly of the lip 32 is a hook 34 with this hook 34 being located within the confines of the recess 30. It is to be noted that the hook 34 is substantially hidden from view by the position of the lip 32. This is desirable since the hook 34 is not a particularly attractive item, and also if the hook 34 protruded exteriorly of the rear surface 20, it could potentially cause damage of the clothes of the people in close proximity and possibly even injury to people. The hook 34 is to facilitate connection with a conventional garment hanger 36. A garment, such as a suit jacket, can be supported on the garment hanger 36. It is to be understood that the garment hanger 36 can be readily disengaged from the hook 34 and also can be readily reengaged with the hook 34.

A human hand 38 can be located within the recess 30 and by contacting the inner surface of the lip 32 to be usable to cause movement of the chair which includes the chair back 10. The use of the handle 28 facilitates the movement of the chair by being pulled in a position out of a desk well, which is not shown, in order for a human user to occupy the chair by sitting on the chair seat 12.

The front surface 18 includes a vertical slit 40. This slit 40 is actually shown as extending entirely from the top edge 22 to the bottom edge 24. However, the slit 40 may actually only extend a partial distance as it is only required that the slit 40 be located in the area of the chair back 10 that is located directly adjacent the bottom edge 24. The slit 40 has sidewalls that are actually abutting when at-rest. It is the function of the slit 40 to form a tight frictionally snug engagement with a pair of thin protuberances 42 and 44. These protuberances 42 and 44 are fixedly mounted to a pad base 46. The pad base 46 has mounted thereon a lumbar support pad 48. The lumbar support pad 48 is to be constructed of a cushiony material with generally a fabric covering a resilient type of padding being common. The lumbar support pad 48 can be moved in the direction of arrow 50 with the protuberances 42 and 44 being adjusted to various positions within the slit 40. Once the lumbar support pad 48 is positioned in a specific desired position that is to accommodate to the lumbar area of the human user, the pad 48 will remain in that position upon it being released due to the frictional engagement between the protuberances 42 and 44 with the sidewalls of the slit 40. It is to be understood that the protuberances 42 and 44 constitute thin, rigid, metallic members but also could be constructed of other rigid material if such is desired. Also, it is considered to be within the scope of this invention that instead of a pair of the protuberances 42 and 44, there may be an increased number of the protuberances or there could only be a single protuberance.

What is claimed is:

1. A chair back having a front surface and a rear surface, said chair back comprising:

a handle formed within said rear surface, said handle adapted to be grasped in order to cause movement of said chair back, a hook mounted in conjunction with said handle, said hook being adapted to connect with a clothes hanger with the suspending of an article of clothing from said chair back; and said chair back adapted to be used by a user sitting in a chair and bracing the user's back against said front surface, said chair back having a slit, a lumbar support pad having a smoothly contoured outer surface and an inner surface, at least one protuberance mounted on said lumbar support pad at said inner surface, said protuberance projecting outwardly from said inner surface, said protuberance to be insertable within said slit forming a snug fit between said protuberance and said chair back, said protuberance being slidably adjustable within said slit and upon a specific position being obtained, said lumbar support pad being fixed to said chair back.

2. The chair back as defined in claim 1 wherein:

said chair back having a top edge and a bottom edge, said bottom edge being adapted to be located directly adjacent a chair seat, said slit extending in a direction substantially transverse to said bottom edge.

3. The chair back as defined in claim 1 wherein:

there being a pair of spaced-apart protuberances mounted on said lumbar support pad.

* * * * *